US005105122A

United States Patent [19]

Konings et al.

[11] Patent Number: 5,105,122

[45] Date of Patent: Apr. 14, 1992

[54] ELECTRODELESS LOW-PRESSURE MERCURY VAPOUR DISCHARGE LAMP

[75] Inventors: Leonardus U. E. Konings; Hubertus Coenen, both of Eindhoven, Netherlands

[73] Assignee: U.S. Philips Corporation, New York, N.Y.

[21] Appl. No.: 567,416

[22] Filed: Aug. 14, 1990

[30] Foreign Application Priority Data

Aug. 18, 1989 [NL] Netherlands ..... 8902093

[51] Int. Cl.[5] ..... H01J 1/62

[52] U.S. Cl. ..... 313/487; 313/486; 313/485

[58] Field of Search ..... 313/487, 485, 486, 487; 252/301.4 R

[56] References Cited

U.S. PATENT DOCUMENTS 3,937,998 2/1976 Verstegen et al. ..... 313/487
4,010,400 3/1977 Hollister ..... 313/485
4,119,889 10/1978 Hollister ..... 313/485
4,298,828 11/1981 Justice et al. ..... 315/248
4,315,198 2/1982 Skwirut et al. ..... 313/487
4,751,426 6/1988 Hoffman ..... 313/487

OTHER PUBLICATIONS

Patent Abstract of Japan, vol. 12, No. 285 (E-642) (3132), Apr. 8, 1988.

*Primary Examiner*—Donald J. Yusko
*Assistant Examiner*—Nimesh D. Patel
*Attorney, Agent, or Firm*—Brian J. Wieghaus

[57] ABSTRACT

An electrodeless low-pressure mercury vapour discharge lamp having a discharge vessel with a radiation transmitting envelope and a cavity, which cavity accommodates a core of magnetic material and a wire winding surrounding said core and connected to a high-frequency supply unit. The envelope is provided with a first luminescent layer and the cavity with a second luminescent layer. Of the two or more luminescent materials present the luminescent material with the greatest depreciation is present exclusively in the first luminescent layer on the envelope.

10 Claims, 1 Drawing Sheet

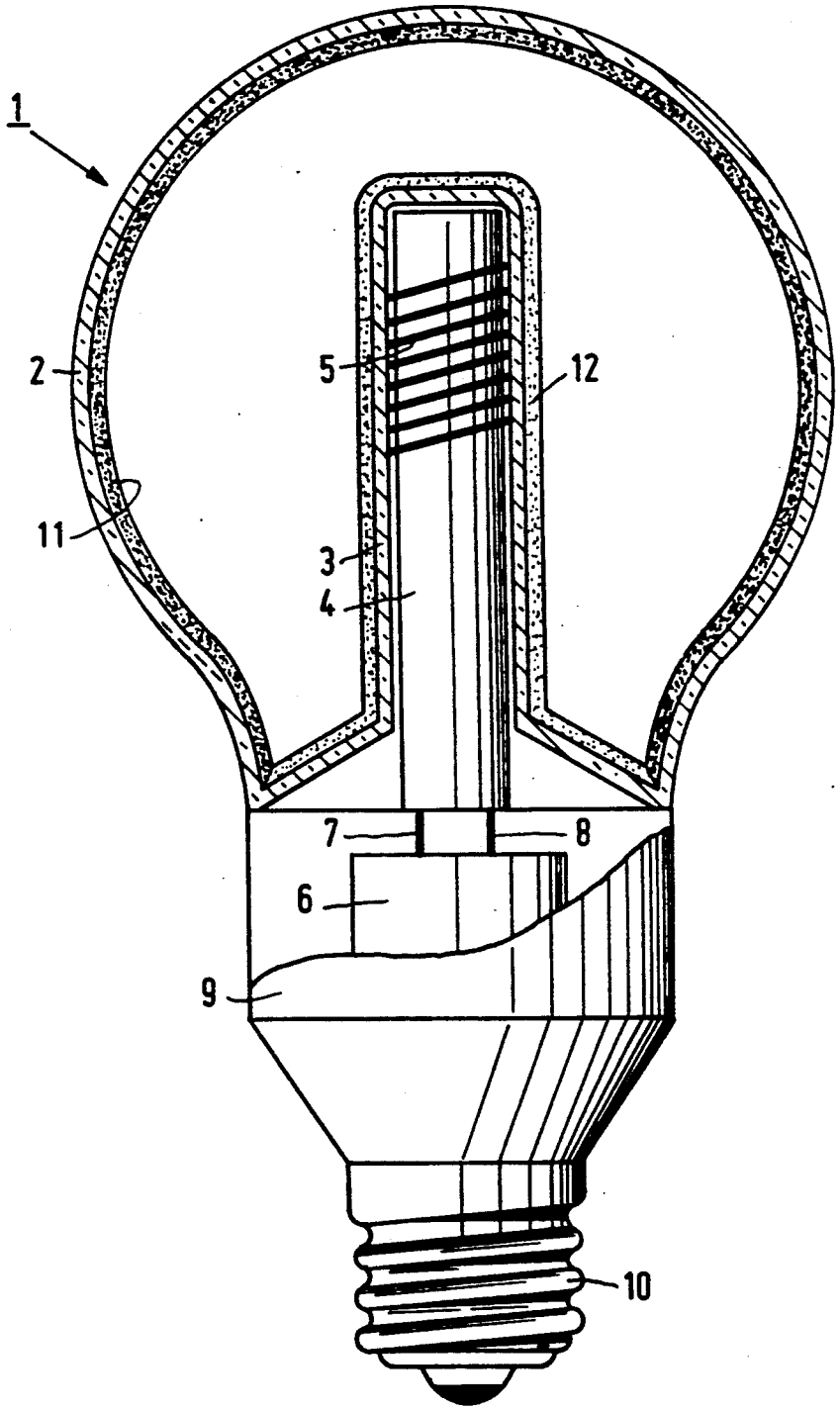
1
2
5
12
11
3
4
7
8
6
9
10

ELECTRODELESS LOW-PRESSURE MERCURY VAPOUR DISCHARGE LAMP

BACKGROUND OF THE INVENTION

The invention relates to an electrodeless low-pressure mercury vapour discharge lamp which comprises a discharge vessel which is sealed in a gas-tight manner and contains mercury and a rare gas, which discharge vessel has a radiation-transmitting envelope and a cavity, which cavity accommodates a core of magnetic material and a wire winding surrounding said core and connected to a high-frequency supply unit, the envelope being provided with a first luminescent layer and the cavity with a second luminescent layer, two or more luminescent materials being present.

A lamp of the aforementioned kind is known from U.S. Pat. No. 4,298,828.

During operation of the electrodeless lamp the high-frequency supply unit connected to the wire winding generates a high-frequency magnetic field in the core of magnetic material, which together with the wire winding surrounding it is present inside the cavity of the discharge vessel but outside the actual discharge space. The magnetic field induces an electric field inside the discharge vessel, so that an electric discharge is maintained in this vessel. Thus short-wave ultraviolet radiation is generated, to a relatively larger degree having a wavelength of 254 nm, and to a lesser degree with a wavelength of 185 nm (mercury resonance lines). This ultraviolet radiation is converted into radiation of a greater wavelength, more particularly visible radiation, by the luminescent layer provided on the inside wall of the discharge vessel. The spectrum of the emitted radiation depends on the luminescent materials present in the luminescent layer.

Since the luminescent layer in the known electrodeless lamp not only covers the wall of the envelope, but also extends over the wall of the cavity, the luminescent material on the cavity also contributes to the conversion of short-wave ultraviolet radiation into visible radiation, which is favourable for the overall luminous efficacy of the lamp.

The U.S. Pat. No. 4,298,828 referred to further mentions that for example, the standard halophosphates can be used as luminescent materials for the luminescent layer, or that a mixture of three phosphors activated by rare earths can be used as described in U.S. Pat. No. 3,937,998.

Known low-pressure mercury vapour discharge lamps for general lighting purposes, in which the luminescent layer consists of a halophosphate with wide emission bands, for example calcium halophosphate activated by antimony and manganese, emit a substantially white light. Such lamps, however, have a moderate general colour rendering (colour rendering index R(a,8) 50–60).

The low-pressure mercury vapour discharge lamps for general lighting purposes known from the aforementioned U.S. Pat. No. 3,937,998 show emission mainly in three relatively narrow spectral regions which is why they are also called three-band fluorescent lamps. The advantage of such lamps is that they have both a good general colour rendering (colour rendering index R(a,8) of at least 80) and a high luminous efficacy (up to values of 90 lm/W and higher). This is possible since the emission of these lamps is mainly concentrated in three relatively narrow spectral bands. For this purpose the lamps contain a red luminescing material with emission mainly in the wavelength region 590–630 nm, a green luminescing material with emission mainly in the wavelength region 520–565 nm, and a blue luminescing material with emission mainly in the wavelength region 430–490 nm. The lamps emit white light of a certain colour temperature, i.e. the colour point (X, Y in the C.I.E. diagram of chromaticity coordinates) of the emitted radiation lies on or near the Planckian locus. A desired colour temperature of the light emitted by a three-band fluorescent lamp is obtained through a suitable setting of the relative contributions in the three spectral regions to the total emission of the lamp.

In the known electrodeless low-pressure mercury vapour discharge lamp provided with two or more luminescent materials, the first luminescent layer on the envelope and the second luminescent layer on the cavity are identical, i.e. they contain the same luminescent materials.

A problem in this known lamp is the lumen maintenance, which is the maintenance of the total luminous flux emitted by the lamp throughout lamp life. It has been found that the luminous flux emitted by the known lamp decreases relatively strongly during lamp life and that this, depending on the luminescent materials used, can be accompanied by an equally undesirable shift of the colour point of the radiation emitted by the lamp.

SUMMARY OF THE INVENTION

The present invention has for its object to provide an improved low-pressure mercury vapour discharge lamp in which the above disadvantages are at least substantially eliminated.

According to the invention, an electrodeless low-pressure mercury vapour discharge lamp of the kind described in the opening paragraph is characterized in that the luminescent material having the greatest depreciation is present exclusively in the first luminescent layer.

The definition of the concept "depreciation" is based on a conventional standard low-pressure mercury vapour discharge lamp (lamp vessel constructed as a closed straight tube, inside which electrodes are positioned at the tube ends) in which the luminescent material is applied in the form of a luminescent layer on the inside wall of the tube. As a standard lamp, for example, a 36 W TL"D" lamp (tube length 120 cm; interior tube diameter 24 mm) may be chosen.

The depreciation of the luminescent material is now understood to mean the decrease in per cents, after 5000 burning hours of the lamp, of the luminous flux supplied by this material after 100 burning hours. Every luminescent material has its own depreciation curve (luminous flux (in %) as a function of the number of burning hours of the lamp). If a standard lamp with a higher wall load is chosen—wall load being defined as the ratio of the power dissipated in the discharge column to the wall surface area—the depreciation process does take place more quickly but each luminescent material still shows its own characteristic depreciation curve.

The main cause of the depreciation is held to be the circumstance that the luminescent material is subjected to collisions with excited mercury atoms and mercury ions from the discharge, as a result of which the mercury reacts chemically with the luminescent material and/or is deposited on it.

The invention is based on the recognition of the fact that the intensity of the mercury discharge in the vicinity of the cavity wall is greater than it is in the vicinity of the envelope wall in the electrodeless low-pressure mercury vapour discharge lamp with its special discharge vessel geometry, the core of magnetic material with the wire winding surrounding it being present inside the cavity, but outside the actual discharge space. As a result, the second luminescent layer on the cavity wall will be subjected to a greater number of collisions with high-energy mercury particles than the first luminescent layer on the envelope wall, so that luminescent materials in the second luminescent layer will depreciate more quickly than those in the first luminescent layer.

Owing to the fact that, according to the invention, among the luminescent materials present the material with the greatest depreciation is present exclusively in the first luminescent layer on the envelope wall, it is achieved that the lumen maintenance of the lamp is improved and that less shift in the colour point of the radiation emitted by the lamp will occur during lamp life.

A favourable embodiment of an electrodeless low-pressure mercury vapour discharge lamp according to the invention provided with a red luminescing material with emission mainly in the wavelength region 590–630 nm, a green luminescing material with emission mainly in the wavelength region 520–565 nm, and a blue luminescing material with emission mainly in the wavelength region 430–490 nm is characterized in that the blue luminescing material is present exclusively in the first luminescent layer.

It has been found that among the known suitable luminescent materials the blue luminescing materials show the greatest depreciation, thus causing also a colour point shift towards the yellow.

A further favourable embodiment of an electrodeless low-pressure mercury vapour discharge lamp according to the invention is characterized in that the first luminescent layer comprises a mixture of a luminescent rare earth metal oxide activated by trivalent europium, a luminescent material activated by trivalent terbium and a luminescent material activated by bivalent europium, and in that the second luminescent layer comprises a mixture of a luminescent rare earth metal oxide activated by trivalent europium and a luminescent material activated by trivalent terbium.

The luminescent materials activated by bivalent europium usually show a relatively great depreciation.

A further favourable embodiment of an electrodeless low-pressure mercury vapour discharge lamp according to the invention is characterized in that the first luminescent layer comprises a mixture of yttrium oxide activated by trivalent europium, cerium-magnesium aluminate activated by trivalent terbium, and barium-magnesium aluminate activated by bivalent europium, and in that the second luminescent layer comprises a mixture of yttrium oxide activated by trivalent europium and cerium-magnesium aluminate activated by trivalent terbium.

The luminescent materials mentioned are known per se.

In this way an interesting electrodeless three-band fluorescent lamp is obtained which exhibits a good general colour rendering, a high luminous efficacy and a good lumen maintenance, as well as a small colour point shift of the emitted radiation during lamp life.

An embodiment of the electrodeless low-pressure mercury vapour discharge lamp according to the invention will now be described in greater detail with reference to a drawing.

BRIEF DESCRIPTION OF THE DRAWING

The FIGURE shows diagrammatically (partly in cross-section, partly in elevation), and not drawn to scale, an electrodeless low-pressure mercury vapour discharge lamp.

DESCRIPTION OF THE PREFERRED EMBODIMENTS

The discharge lamp of the FIGURE has a glass discharge vessel 1 sealed in a gas-tight manner, which contains mercury and a rare gas. The discharge vessel 1 has an envelope 2 and a cavity 3. The cavity 3 accommodates a rod-shaped core 4 of magnetic material (ferrite) and a wire winding 5 surrounding the core and connected to a high-frequency electric supply unit 6 via supply wires 7 and 8. The electric supply unit 6, which comprises an electric circuit as described, for example, in the Netherlands Patent Application 8004175, is arranged inside a housing 9 of synthetic material which is at one end attached to the discharge vessel 1 and at the other end provided with an Edison lamp cap 10, with which the supply unit 6 is electrically connected.

A first luminescent layer 11 is provided on the inside of the discharge vessel 1, on the wall of the envelope 2, and a second luminescent layer 12 on the wall of the cavity 3. Before the envelope 2 and the cavity 3 are sealed together in a gas-tight manner, the two luminescent layers are applied in a usual manner, for example by means of a suspension containing the luminescent materials used. If so desired, the envelope 2 may, for example, be partly provided with a reflecting layer before the first luminescent layer 11 is applied. It is also possible, for example, to apply a reflecting layer on the wall of the cavity 3 before the second luminescent layer 12 is realised.

The first luminescent layer 11 on the envelope 2 contains a mixture of three luminescent materials: red luninescing yttrium oxide activated by trivalent europium ($Y_2O_3:Eu^{3+}$), green luminescing cerium-magnesium aluminate activated by trivalent terbium ($CeMgAl_{11}O_{19}:Tb^{3+}$) and blue luminescing barium-magnesium aluminate activated by bivalent europium ($BaMgAl_{10}O_{17}:Eu^{2+}$). The second luminescent layer 12 on the cavity 3 contains a mixture of two luminescent materials: red luminescing yttrium oxide activated by trivalent europium ($Y_2O_3:Eu^{3+}$) and green luminescing cerium-magnesium aluminate activated by trivalent terbium ($CeMgAl_{11}O_{19}:Tb^{3+}$). The blue luminescing barium-magnesium aluminate activated by bivalent europium, therefore, is present exclusively in the first luminescent layer 11 on the envelope 2. This material has the greatest depreciation of the three luminescent materials mentioned.

During lamp operation, a high-frequency magnetic field is generated in the core 4 of magnetic material by means of the wire winding 5 which is connected to the supply unit 6. The electric field induced in the discharge vessel 1 by the magnetic field ensures that a mercury discharge is maintained inside the discharge vessel, whereby ultraviolet radiation is generated. This ultraviolet radiation is converted for the major part into visible radiation by the three luminescent materials in layer 11 and by the two luminescent materials in layer 12.

Since the mercury discharge is more intense in the vicinity of the cavity 3, close to the core 4, than in the vicinity of the envelope 2, farther away from the core 4, the luminescent materials in layer 12 depreciate more quickly than those in layer 11. Since, however, the blue luminescing barium-magnesium aluminate activated by bivalent europium, which has relatively the greatest depreciation, is present exclusively in the first luminescent layer 11 on the envelope 2 where it is less strongly influenced by the mercury discharge, the lamp as a whole has an improved lumen maintenance and a smaller shift of the colour point towards the yellow of the radiation emitted by the lamp during lamp life. During experiments 4 electrodeless low-pressure mercury vapour discharge lamps with a bulb diameter of 110 mm were made, containing, apart from a quantity of mercury, argon at a filling pressure of 33 Pa. The power consumed by the lamps was 70 W.

Both the first luminescent layer 11 on the envelope 2 and the second luminescent layer 12 on the cavity 3 of 2 lamps consisted of a mixture of 6.3% by weight $BaMgAl_{10}O_{17}:Eu^{2+}$, 34.3% by weight $CeMgAl_{11}O_{19}:Tb^{3+}$, and 59.4% by weight $Y_2O_3:Eu^{3+}$. The powder layer weight on the envelope 2 was 3.3 mg/cm$^2$ and on the cavity 3 12 mg/cm$^2$. Both lamps had a colour point with the colour coordinates x=0.410 and y=0.380 after 100 burning hours.

In the 2 other lamps, the first luminescent layer 11 on the envelope 2 consisted of the same mixture as in the above-mentioned 2 lamps. The powder layer weight of this layer was 3.3 mg/cm$^2$. The second luminescent layer 12, however, on the cavity 3 here consisted of a mixture of 23% by weight $CeMgAl_{11}O_{19}:Tb^{3+}$ and 77% by weight $Y_2O_3:Eu^{3+}$ (so without $BaMgAl_{10}O_{17}:Eu^{2+}$. The powder layer weight of this layer was 10.3 mg/cm$^2$. These 2 lamps had a colour point with the colour coordinates x=0.417 and y=0.383 after 100 burning hours.

Between 100 and 2000 burning hours a greater shift in the colour point towards the y-coordinate (i.e. towards the yellow/green area in the C.I.E. colour triangle) of $\Delta y=0.002$ occurred for the lamps with $BaMgAl_{10}O_{17}:Eu^{2+}$ on the cavity 3 compared with the lamps without this luminescent material on the cavity 3, which difference will become ever greater with longer operating periods.

We claim:

1. An electrodeless low-pressure mercury vapor discharge lamp comprising a discharge vessel which is sealed in a gas-tight manner and contains mercury and a rare gas, said discharge vessel having a radiation-transmitting envelope and a cavity, said cavity accommodating a core of magnetic material and a wire winding surrounding said core, the envelope being provided with a first luminescent layer and the cavity with a second luminescent layer, said first and second luminescent layers comprising a plurality of luminescent materials, characterized in that: the luminescent material having the greatest depreciation is present exclusively in said first luminescent layer on said envelope.

2. An electrodeless low-pressure mercury vapor discharge lamp as claimed in claim 1, wherein said first and second luminescent layers comprise collectively a red luminescing material with emission mainly in the wavelength region 590–630 nm, a green luminescing material with emission mainly in the wavelength region 520–565 nm, and a blue luminescing material with emission mainly in the wavelength region 430–490 nm, characterized in that: the blue luminescing material is present exclusively in said first luminescent layer on the envelope.

3. An electrodeless low-pressure mercury vapour discharge lamp as claimed in claim 2, characterized in that: said first luminescent layer comprises a mixture of a rare earth metal oxide activated by trivalent europium, a luminescent material activated by trivalent terbium, and a luminescent material activated by bivalent europium, and in that said second luminescent layer comprises a mixture of a rare earth metal oxide activated by trivalent europium and a luminescent material activated by trivalent terbium.

4. An electrodeless low pressure-mercury vapour discharge lamp as claimed in claim 3, characterized in that: said first luminescent layer comprises a mixture of yttrium oxide activated by trivalent europium, cerium-magnesium aluminate activated by trivalent terbium, and barium-magnesium aluminate activated by bivalent europium, and in that said second luminescent layer comprises a mixture of yttrium oxide activated by trivalent europium and cerium-magnesium aluminate activated by trivalent terbium.

5. A low-pressure gas discharge lamp having a discharge vessel sealed in a gas-tight manner, said discharge vessel having an outer radiation transmitting wall and an inner wall and containing an ionizable material, means for ionizing said ionizable material for generating a gas discharge within said discharge vessel, said discharge being closer to said inner wall than said outer wall, and a first luminescent layer on said outer wall and a second luminescent layer on said inner wall, said luminescent layers being comprised of a plurality of luminescent materials, one of said luminescent materials having a greater depreciation than the other luminescent materials, the improvement comprising:

said luminescent material having the greatest depreciation being present exclusively in said first luminescent layer on said outer wall.

6. An electrodeless low-pressure mercury vapor discharge lamp as claimed in claim 5, wherein said first and second luminescent layers comprise collectively a red luminescing material with emission mainly in the wavelength region 590–630 nm, a green luminescing material with emission mainly in the wavelength region 520–565 nm, and a blue luminescing material with emission mainly in the wavelength region 430–490 nm, characterized in that: the blue luminescing material is present exclusively in said first luminescent layer on the outer wall.

7. An electrodeless low-pressure vapor discharge lamp, comprising:

a) a discharge vessel sealed in a gas-tight manner and containing an ionizable material, said discharge vessel having an outer envelope wall and an inner cavity wall defining a cavity in said discharge vessel;

b) means within said cavity for generating an electric field within said discharge vessel to ionize said ionizable material to emit radiation; and c) first and second luminescent layers within said discharge vessel on said outer envelope and inner cavity walls, respectively, said first and second luminescent layers comprising a plurality of luminescent materials, the luminescent material having the greatest depreciation not being present in said second luminescent layer on said inner cavity wall.

8. An electrodeless low-pressure mercury vapor discharge lamp as claimed in claim 7, wherein said first and second luminescent layers comprise collectively a red luminescing material with emission mainly in the wavelength region 590–630 nm, a green luminescing material with emission mainly in the wavelength region 520–565 nm, and a blue luminescing material with emission mainly in the wavelength region 430–490 nm, characterized in that: the blue luminescing material is not present in said second luminescent layer on said inner cavity wall.

9. An electrodeless low-pressure mercury vapor discharge lamp as claimed in claim 8, characterized in that: said first luminescent layer comprises a mixture of a rare earth metal oxide activated by trivalent europium, a luminescent material activated by trivalent terbium, and a luminescent material activated by bivalent europium, and in that said second luminescent layer comprises a mixture of a rare earth metal oxide activated by trivalent europium and a luminescent material activated by trivalent terbium.

10. An electrodeless low-pressure mercury vapor discharge lamp as claimed in claim 9, characterized in that: said first luminescent layer comprises a mixture of yytrium oxide activated by trivalent europium, cerium-magnesium aluminate activated by trivalent terbium, and barium-magnesium aluminate activated by bivalent europium, and in that said second luminescent layer comprises a mixture of yytrium oxide activated by trivalent europium and cerium-magnesium aluminate activated by trivalent terbium.

* * * * *